US007799199B2

(12) United States Patent
Dulcetti et al.

(10) Patent No.: US 7,799,199 B2
(45) Date of Patent: Sep. 21, 2010

(54) PROCESS AND PLANT FOR DESCALING, PICKLING AND FINISHING PASSIVATING STAINLESS STEEL STRIPS, AND STRIPS SO OBTAINABLE

(75) Inventors: Alessandro Dulcetti, Rome (IT); Stefano Luperi, Rome (IT); Gianvincenzo Salamone, Terni (IT); Giovanni Vespasiani, Terni (IT); Stefano Mantovani, Milan (IT); Yean Demertzis, Milan (IT)

(73) Assignees: Centro Sviluppo Materiali S.p.A., Rome (IT); Thyssenkrupp Acciai Speciali Terni S.p.A., Terni (IT); Henkel KGAA, Dusseldorf (DE)

( * ) Notice: Subject to any disclaimer, the term of this patent is extended or adjusted under 35 U.S.C. 154(b) by 1236 days.

(21) Appl. No.: 10/499,330

(22) PCT Filed: Dec. 29, 2002

(86) PCT No.: PCT/IT02/00810

§ 371 (c)(1),
(2), (4) Date: Jul. 8, 2005

(87) PCT Pub. No.: WO03/052165

PCT Pub. Date: Jun. 26, 2003

(65) Prior Publication Data

US 2006/0037868 A1 Feb. 23, 2006

(30) Foreign Application Priority Data

Dec. 19, 2001 (IT) ..... RM2001A0747

(51) Int. Cl.
*C25F 1/06* (2006.01)

(52) U.S. Cl. ..... 205/640; 205/687; 205/736

(58) Field of Classification Search ..... 205/640, 205/687, 736
See application file for complete search history.

(56) References Cited

U.S. PATENT DOCUMENTS

| | | | | |
|---|---|---|---|---|
| 2,468,239 | A * | 4/1949 | Saulino | 264/135 |
| 5,743,968 | A | 4/1998 | Leeker et al. | |
| 6,174,383 | B1 | 1/2001 | Angel et al. | |

FOREIGN PATENT DOCUMENTS

| | | |
|---|---|---|
| EP | 0 582 121 A1 | 2/1994 |
| WO | WO-99/32690 | 7/1999 |
| WO | WO-00/15880 | 3/2000 |

* cited by examiner

*Primary Examiner*—Alexa Neckel
*Assistant Examiner*—Zulmariam Mendez
(74) *Attorney, Agent, or Firm*—Browdy and Neimark, PLLC

(57) ABSTRACT

Environment-friendly process for descaling, pickling and finishing/passivating in a continuous, integrated and flexible manner, applicable to any type of stainless steel, regardless of its physical structure, chemical composition and nature of surface oxides to be removed, within a single plant in which the required chemical, electrochemical, mechanical and hydromechanical treatments are carried out, merely diversifying the operative conditions of each treatment according to the stainless steel type to be processed. The process and the plant according to the invention allow elevated reaction rate, excellent surface quality, low energy and chemical reagent consumption and total environmental compatibility. The figure shows the block diagram of an embodiment of the plant according to the invention.

21 Claims, 2 Drawing Sheets

Figure 1:
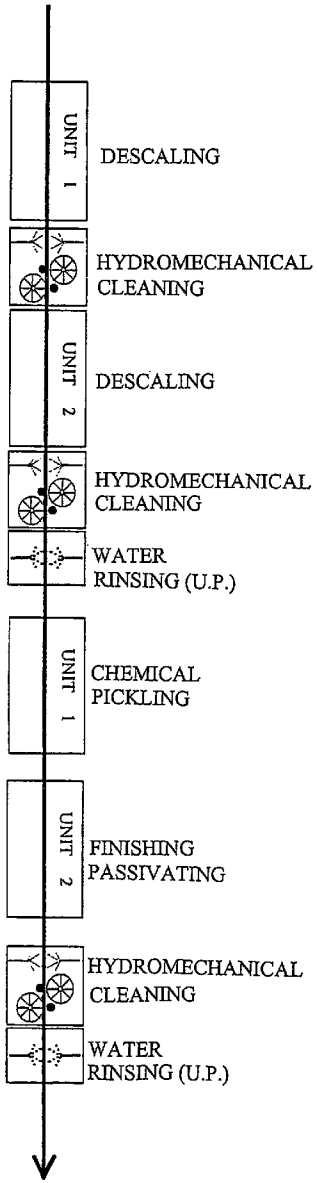

PROCESS AND PLANT FOR DESCALING, PICKLING AND FINISHING PASSIVATING STAINLESS STEEL STRIPS, AND STRIPS SO OBTAINABLE

The present invention refers to the descaling, the pickling and the finishing/passivating, in the absence of nitric acid and of molten salt baths, for stainless steel strips, previously hot-rolled and optionally annealed or cold-rolled and annealed.

As it is known, stainless steel pickling is carried out in order to eliminate the scale of thermal oxides generated during hot rolling and/or annealing treatments, and to dissolve the chromium-depleted alloy layer (dechromized layer) therebelow. This process is conventionally carried out in three distinct and separate process steps: a first step of descaling, i.e. of chemical-physical modification of the scale, with partial or total removal of the latter; a second step of actual pickling, i.e. of removing any residual scale and the underlying chromium-depleted alloy layer; and a third step, of surface finishing and passivating. In several instances, the last two steps of pickling and of finishing/passivating may be carried out jointly.

The state of the art envisages several manners for conducting the descaling step, depending on the type of oxide present onto the metal at the end of the metallurgical treatments.

In order to remove the oxide generated in the hot rolling and annealing processes, the descaling, pickling and finishing/passivating treatments are usually preceded by scale-breaking treatments (scale-breaker, grit-blasting and abrasive brushing) which fragment and partially remove said scale. For cold-rolled stainless steel products the scale is not mechanically preconditioned, as often this treatment is not compatible with the surface quality required for the finished product.

Generally, for the step of descaling cold-rolled and annealed stainless steel processes are resorted to capable of inducing a substantial modification of the oxides, facilitating the dissolving thereof.

To this end, the most widely adopted methodologies are:

a) thermo-chemical descaling, consisting in the immersing the material to be pickled in an oxidant molten salt bath (400-600° C.) capable of altering the scale by increasing the oxidation grade of the oxide-constituting metals. In particular, Kolene (eutectic of the ternary system NaOH, $NaNO_3$ and NaCl) baths at temperatures of about 500° C. are widely resorted to;

b) electrolytic descaling by neutral solutions of sulfates or acid solutions, with partial modification of the oxidation states of the metals constituting the scale and the resulting dissolution of the latter.

Generally, the stainless steel pickling step is conducted using acid baths having an elevated oxidizing ability, capable of dissolving the underlying chromium-depleted alloy layer.

These baths mainly consist of mineral acid mixtures, the most widespread thereamong being:

1) nitric and hydrofluoric acid mixtures at temperatures generally ranging from 50 to 75° C.;

2) sulfuric, hydrofluoric, hydrochloric and phosphoric acid mixtures with additions of highly oxidizing agents, among which, e.g., permanganates, persulfates, ferric chloride, ferric sulfate and hydrogen peroxide, with a temperature ranging from 50 to 100° C.

The passivating/finishing step is also aimed at generating a protective passive film. When not carried out in the same pickling step, it is usually attained in baths having a high redox potential. These baths mainly contain nitric acid or the abovementioned acids and oxidants in lesser concentrations and with a lesser content of steel-constituting metal ions.

Moreover, to date several processes do exist related to stainless steel descaling and pickling steps, based on the employ of nitric acid-free acid solutions are available. In particular, stainless steel pickling processes are known based on the use of nitric acid-free acid solutions, whose oxidizing power derives from the presence of different elements, among which ferric ions, hydrogen peroxide and persulfates.

In particular, DE-A-19624436, WO 9826111, EP-A-763609 and JP95-130582 describe processes of descaling as well as of pickling in a nitric acid-free acid solution, also with the use of DC-powered electrolytic cells (current density ranging from 0.5 to 250 $A/dm^2$).

DE-C-3937438 describes a process in which the direct electric current is employed for the reoxidation of ferrous ions to ferric ions in a hydrochloric acid solution.

EP-A-838542 describes a descaling process in an aqueous solution of sodium sulfate, with a concentration ranging from 10 to 350 g/l, wherein the strip is vertically passed through pairs of counterelectrodes between which direct electric current having a density ranging from 20 to 250 $A/dm^2$ is applied.

EP0582121 and EP0505606 describe chemical pickling processes wherein the strip is immersed in sulfuric acid-based solutions containing ferric ions and hydrofluoric acid, in which ferrous ion reoxidation is mainly carried out by addition of hydrogen peroxide under continuous air injection.

However, the known technologies summarily reported hereinbefore present significant drawbacks of environmental nature and of working safety, as well as of pickling process management in terms of control and costs.

Chemical descaling carried out with molten salts is particularly difficult to manage, due to the dangerousness associated to the elevated temperature (400-600° C.) of the bath, as well as to the difficulty of treating the rinsing solutions of the metallic product to be descaled. In fact, these rinsing solutions contain non-negligible quantities of toxic hexavalent chromium and of nitrites and nitrates. In neutral sodium sulfate solutions as well the electrolytic descaling exhibit the same drawback: in fact, the process fluids contain non-negligible quantities of hexavalent chromium. Electrolytic descaling treatments in sulfuric acid-based solutions, though overcome the drawback of chromium (VI), can determine an inferior surface quality by effect of the localized attacks caused by the sulfuric acid in sections not subjected to the electric field.

The employ of baths containing nitric acid for the pickling and the finishing/passivating steps entails relevant environmental problems, due to several reasons. Among the latter, the most important are as follows:

A) difficulty of safely abating the highly polluting nitrogen oxides ($NO_x$) developed from the acid-metal reactions;

B) difficulty of respecting the environmental provisions in force for the disposal of spent solutions with regard to their elevated nitrate content;

C) utmost difficulty of keeping nitrate concentrations within the limits set by the provisions in force for said species in rinsing waters.

The present invention allows to overcome all of the abovementioned drawbacks, with the further advantage of providing an environment-friendly process for descaling, pickling and finishing/passivating in a continuous, integrated and flexible manner which is applicable to any type of stainless steel strip within a single plant by adopting a sequence of treatments, wherein the operative conditions of each treatment are diversified according to the typology of stainless steel to be processed as well as to the nature of the oxides to be removed present onto the stainless steel strip surface.

In fact, a subject of the present invention is a process for descaling, pickling and finishing/passivating stainless steel strips, wherein the strip to be processed is subjected to the following sequence of steps:

an electrolytic and/or chemical descaling treatment, differentiated into two hydraulically distinct units using aqueous solutions, wherein:

said descaling, in case of electrolytic treatment, uses aqueous solutions containing in the first unit:

from 10 to 250 g/l $H_2SO_4$;

with <80 g/l total dissolved Fe;

and optionally $\geqq$15 g/l $Fe^{+3}$, with $Fe^{+3}/Fe^{+2} \leqq 1.0$;

and, in the second unit:

from 10 to 250 g/l $H_2SO_4$;

$\geqq$2 g/l $Fe^{3+}$;

with <80 g/l total dissolved Fe;

and optionally with $Fe^{3+}/Fe^{2+} \leqq 1.0$;

with induction onto the strip of at least one anode-cathode or anode-cathode-anode polarity sequence applied by pairs of electrodes having the same polarity, between which the strip runs, with anodic treatment times ($t_a$) and anodic current density (I) selected so as to satisfy the relation $$t_a > k + c/I$$

where:

$t_a$ is the anodic treatment time [s];

k is an experimental constant, its values ranging from 2 to 15 s;

c is an experimental constant, its values ranging from 40 to 120 C/dm$^2$; and

I is the anodic current density, its values ranging from 1 to 100 A/dm$^2$;

and with times during which the strip is not subjected to the electric field that range from the 5% to the 60% of the total electrolytic descaling time;

said descaling, in case of chemical treatment, uses aqueous solutions containing in both units from 25 to 280 g/l $H_2SO_4$;

said strip being subjected to said descaling treatment for an overall time comprised in the range 10-250 s, at temperatures comprised in the range 20-105° C.;

a chemical pickling, optional, and/or finishing/passivating treatment, differentiated into two hydraulically distinct units, wherein:

said chemical pickling treatment uses aqueous solutions containing:

from 20 to 180 g/l $H_2SO_4$;

from 5 to 50 g/l free HF;

$\geqq$15 g/l $Fe^{+3}$;

$Fe^{+3}/Fe^{+2} \geqq 0.8$;

with <80 g/l total dissolved Fe;

said chemical finishing/passivating treatment uses aqueous solutions containing:

from 10 to 100 g/l $H_2SO_4$;

from 0 to 15 g/l free HF;

<20 g/l $Fe^{+3}$;

>0.03 mol/l $H_2O_2$;

said strip being subjected to said chemical pickling and/or finishing/passivating treatment for an overall time ranging from 2 to 250 s, at temperatures ranging from 20 to 80° C.; and there being provided, for each pickling and/or finishing/passivating treatment unit, a solution recirculation with a flow rate equal to at least 10 dm$^3$/h per m$^2$ of strip;

there being provided, at least at the end of each descaling, pickling and/or finishing/passivating treatment unit, a mechanical and/or hydromechanical and/or water-employing cleaning treatment, optionally by water jets having a >100 bar pressure.

In the electrolytic descaling treatments, the application of anode-cathode or anode-cathode-anode polarity sequences onto the strip may be attained connecting the electrodes to the power supply units 'per face', i.e. connecting each power supply unit exclusively to electrodes adjacent and facing a same face of the strip. The anodic/cathodic polarization time ratio of the strip is $\geqq$1.5.

For the electrolytic descaling of austenitic stainless steel strips, in the two electrolytic units can be used the following solutions:

a) in the first unit from 30 to 150 g/l $H_2SO_4$;

max 60 g/l dissolved Fe;

40-95° C. temperature;

b) in the second unit from 30 to 120 g/l $H_2SO_4$;

$\geqq$10 g/l $Fe^{+3}$, with $Fe^{+3}/Fe^{+2} \geqq 1.0$;

max 60 g/l dissolved Fe;

30-80° C. temperature.

For ferritic or martensitic stainless steel strips, at least in the descaling treatment, can be used solutions distinct for composition and/or temperatures, having a >20 g/l ferric ($Fe^{+3}$) ion concentration and a $Fe^{+3}/Fe^{+2}$ concentration ratio of >1.5.

Moreover, for the electrolytic descaling treatment of ferritic or martensitic stainless steel strips, the time during which the strip is not subjected to the electric field ranges from the 15% to the 25% of the total electrolytic descaling time.

For optionally annealed hot-rolled stainless steel strips, the descaling treatment may optionally be preceded by a mechanical and/or hydromechanical scale breaking/removing treatment.

The chemical pickling treatment for austenitic stainless steels may be carried out in aqueous solutions optionally distinct in composition and/or temperatures and consisting of:

from 40 to 180 g/l $H_2SO_4$;

from 15 to 50 g/l free HF;

>20 g/l $Fe^{3+}$, with $Fe^{3+}/Fe^{2+}$>0.8;

max 70 g/l dissolved Fe;

50-75° C. temperature;

for times ranging from 20 to 150 s.

For optionally annealed hot-rolled ferritic and martensitic stainless steels the chemical pickling and finishing/passivating treatments may be carried out, respectively:

as to the pickling treatment, in aqueous solutions containing from 40 to 180 g/l $H_2SO_4$;

from 5 to 50 g/l free HF;

$\geqq$20 $Fe^{3+}$, with $Fe^{3+}/Fe^{2+}$>0.8;

<80 g/l dissolved Fe;

at temperatures ranging from 20 to 70° C.;

for times ranging from 10 to 160 s;

and, as to the finishing treatment, in aqueous solutions containing;

from 20 to 100 g/l $H_2SO_4$;

from 0 to 35 g/l free HF;

<20 g/l $Fe^{3+}$;

>0.03 mol/l $H_2O_2$;

at temperatures ranging from 20 to 50° C.;

for times ranging from 2 to 80 s.

The ferritic and martensitic steels, cold rolled and annealed after the electrolytic descaling treatment, may be subjected to the sole finishing treatment in aqueous solutions containing:

from 20 to 70 g/l $H_2SO_4$;

<15 g/l $Fe^{3+}$;

>0.05 mol/l $H_2O_2$;

from 0 to 15 g/l free HF;

at temperatures ranging from 20 to 50° C.;

for times ranging from 5 to 80 s.

Preferably, the finishing/passivating treatment is carried out applying the solution with spraying nozzles allowing a turbulent and homogeneous distribution of the solution onto the surfaces of the strip to be treated, so as to ensure a flow rate not lower than 15 $dm^3$/h per $m^2$ of strip.

In order to assure effectiveness of the end treatment and high quality of the end product, the surfaces of the strips, which after the descaling treatment are subjected to the sole finishing/passivating treatment, in the time interval between the former and the latter are kept moist in a room saturated with ambient-pressure steam.

In order to maintain the correct concentration of the ferric ions $Fe^{+3}$ and $Fe^{+3}/Fe^{+2}$ concentration ratio, an at least stoichiometrical quantity of optionally stabilized hydrogen peroxide is inletted in the descaling and pickling solutions.

While crossing the chemical pickling units, the strips, subjected to the sole finishing/passivating treatment after the descaling treatment, are kept with their surfaces moist, in a room saturated with ambient-pressure steam.

The invention also refers to the descaled, pickled and finished/passivated stainless steel strips obtainable with the abovedescribed process.

A further subject of the invention is a plant suitable for carrying out the environment-friendly process for descaling, pickling and finishing/passivating, in a continuous, integrated and flexible manner, stainless steel strips as abovedescribed.

The plant suitable for carrying out the process according to the invention comprises:

two hydraulically distinct units for the descaling treatment, each comprising:

at least one electrolytic or chemical cell, each electrolytic cell being provided with at least one set of pairs of electrodes facing the strip and located so as to induce at least one cathode-anode or anode-cathode-anode polarity sequence onto the strip;

wherein in the electrolytic descaling cells the pairs of electrodes anodically polarizing the strip have a total length (L) such as to satisfy the relation:

$$L>(c/I+k)v$$

where:

L is the length of the pairs of electrodes anodically polarizing the strip [m];

c is an experimental constant, its values ranging from 40 to 120 C/$dm^2$;

I is the anodic current density at the highest plant rate, its values being selected in the range 1-100 A/$dm^2$;

k is an experimental constant, its values ranging from 2 to 15 s;

v is the highest plant rate [m/s];

means for recirculating the solution;

means for controlling the temperature of the solutions;

means for the hydromechanical and/or the water-employing rinsing treatment, optionally under high pressure, of the strip, located downstream of the second unit and optionally downstream of the first unit;

two hydraulically distinct units for the pickling and the finishing/passivating treatment, each unit comprising:

at least one chemical cell, preferably provided, for the finishing/passivating treatment, with means for spraying the solution onto the strip;

means for recirculating the solution, capable of ensuring a flow rate at least equal to 10 $dm^3$/h per $m^2$ of strip;

means for controlling the temperatures desired for the solutions; means for the hydromechanical and/or the water-employing rinsing treatment of the strip, optionally under high pressure, located downstream of the finishing/passivating treatment unit.

The 'per face' connection of the electrodes to the power supply units (i.e. each power supply unit being exclusively connected to adjacent electrodes of a same face of the strip) makes the current lines outletted from each single power supply unit interest only one side of the strip, regardless of the position of the latter, ensuring homogeneity of treatment, in terms of current density, onto both faces of the strip. Moreover, the ratio between the lengths of the electrodes inducing the anodic and the cathodic polarity is greater than 1.5 and the time during which the strip is not subjected to the electric field ranges from the 5% to the 60%, preferably from the 15% to the 30%, of the total electrolytic descaling time.

According to the present invention, the polarity sequence is such that the strip outletted from the electrolytic sections is subjected to anodic polarization as a last step, in order to facilitate the generation of a protective passive film.

The means for controlling the temperatures of the solutions in the different units may be heat exchangers.

The means for spraying the finishing/passivating solution onto the strip may be spraying nozzles capable of ensuring a flow rate at least equal to 15 $dm^3$/h per $m^2$ of strip and a turbulence at the strip/solution interface having, at quiescent line and onto the top face of the strip, a Reynolds number equal to at least 50,000.

Apart from the advantageous availability of an integrated and flexible system, the process and the plant for descaling, pickling and finishing/passivating stainless steel strips according to the present invention exhibit the following advantages:

elevated process kinetics;

excellent surface quality in terms of surface finishing and of passivability;

low energy and chemical substance consumptions;

total environmental compatibility.

So far, the invention has been generally outlined. With the aid of the annexed figures and of the following examples, hereinafter a more detailed description of embodiments thereof will be given, aimed at making apparent the objects, the advantages and the operation modes thereof.

FIG. 1 shows a block diagram of the treatment sequence of an embodiment of the plant for descaling, pickling and finishing/passivating stainless steel strips according to the present invention.

Figure 2:
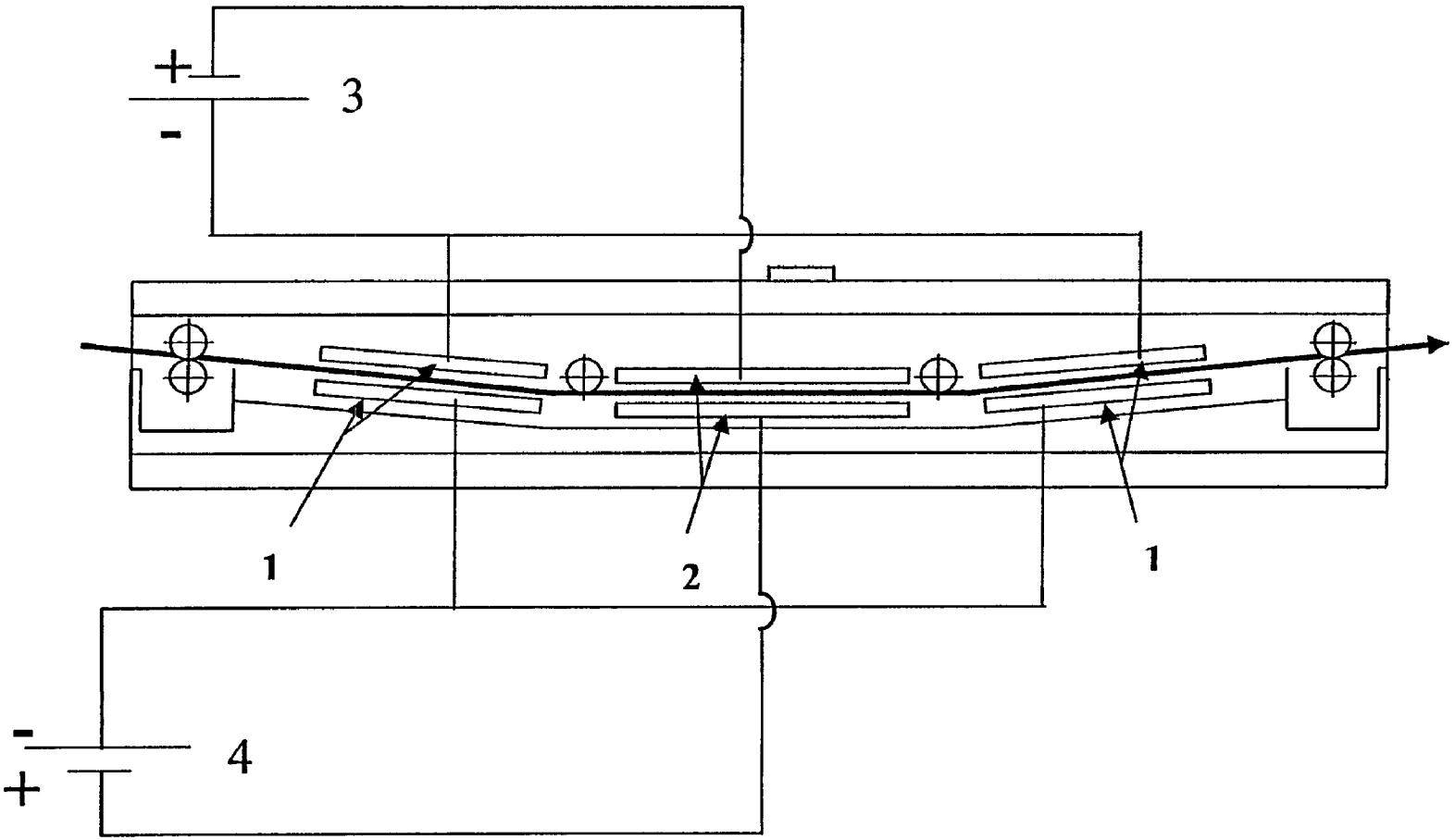

FIG. 2 shows a diagram of an embodiment of an electrolytic cell according to the present invention in which there are indicated the electrodes electrically polarizing the strip (1) and the electrodes cathodically polarizing the strip (2), the related interelectrode spaces, as well as the diagram of the wiring adopted between the electrodes and the poles of the two power supply units (3, 4) with which the cell is equipped.

EXAMPLE 1

In this example there are described the representative sections of a typical plant capable of treating hot-rolled optionally annealed stainless steel strip and cold-rolled and annealed stainless steel strips having a width ranging from 900 to 1,600 mm and a thickness ranging from 0.3 to 3 mm at rates ranging from 10 to 100 m/min, consisting of:

electrolytic/chemical descaling treatment section, comprising:

a first descaling unit;

an intermediate hydromechanical cleaning system;

a second descaling unit;

a second hydromechanical cleaning system using high-pressure water jets;

chemical pickling and finishing/passivating treatment section, comprising:

a pickling unit;

a finishing/passivating unit;

a hydromechanical cleaning and rinsing unit using high-pressure water jets.

Moreover, for each unit there have been installed bath controlling and managing devices, allowing analyzing, automated reagent additioning and spent solution scavenging.

Electrolytic/Chemical Descaling Treatment Section

This section consists of two hydraulically distinct descaling units, the first unit comprising four electrolytic cells and the second unit comprising two electrolytic cells, each of a length equal to about 8 m. Each cell is provided with three pairs of electrodes facing the strip, electrically separated thereamong and located so as to realize a cathode-anode-cathode sequence on the strip. Each electrolytic cell is equipped with two DC power supply unit, each of the latter being capable of outputting a maximum direct current equal to 7.5 kA. Each power supply unit is connected to three electrodes located onto the same face with respect to the strip surface.

The overall length of the pairs of electrodes anodically polarizing the strip is equal to 21.6 m, satisfying the relation $L>(c/I+k)v$ where the values of I, v, c and k are respectively equal to 12 A/dm$^2$, 1.67 m/s, 90 C/dm$^2$ and 4 s. The electrode width is equal to about 1.8 m.

In FIG. 2, as mentioned hereinbefore, there is reported the illustrative diagram of an electrolytic cell, indicating the electrodes anodically polarizing the strip (1) and the electrodes cathodically polarizing the strip (2) the related interelectrode spaces, as well as the diagram of the wiring adopted between the electrodes and the poles of the two power supply units (3, 4) of which the cell is equipped.

At the outlet of the first descaling unit there is a hydromechanical cleaning system consisting of a water jet rinsing, as well as of a pair of brush rolls acting onto the two faces of the strip for removing detached but not yet removed oxide particles. At the outlet of the second descaling unit there is a second hydromechanical cleaning system consisting of a water jet rinsing and of a pair of brush rolls, upstream of a high-pressure rinsing system capable of sending onto the two faces of the strip a rinsing water flow equal to at least 20 m$^3$/h at a pressure of about 120 bar. The temperature of the descaling solution is held at the desired values with heat exchangers and steam jets internal to the different treatment units. The system for controlling the temperature of the descaling solutions allows to set and to hold temperatures ranging from 40 to 80° C.

Chemical Pickling and Finishing/Passivating Treatment Section

The chemical treatment section consists of two hydraulically distinct units, the first one dedicated to the chemical pickling and the second one dedicated to the surface finishing/passivating treatment. At the outlet of the second unit there is installed a hydromechanical cleaning system consisting of a water jet rinsing and of a pair of brush rolls, upstream of a high-pressure rinsing system capable of sending onto the two faces of the strip a rinsing water flow equal to at least 20 m$^3$/h at a pressure of about 120 bar.

The pickling unit consists of two 2 tanks having a length equal to about 18 m, the strip being immersed in the bath in each one thereof, both having a system for recirculating the pickling solution with an overall flow rate of about 400 m$^3$/h. Said tanks provide an elevated turbulence at the solution-strip interface, with a Reynolds number value at least equal to 10.000 at quiescent line. The working temperatures are attained via steam flows, whereas temperature control is attained with a system of heat exchangers made of a material resistant to the HF-containing oxidizing pickling solutions.

For strips which after the descaling process should be subjected to the sole finishing/passivating treatment, inside of the two pickling unit tanks there are installed moisturizing systems that are capable, in the absence of pickling solutions, of keeping moist both strip surfaces in a room saturated with ambient-pressure steam. The finishing/passivating unit is realized with a single tank having a length equal to 21 m, inside which the strip is subjected to the action of the finishing/passivating solution by a spraying system at a pressure of about 0.5 bar capable of ensuring a solution flow rate equal to about 300 m$^3$/h and an elevated turbulence at the solution-strip interface, having onto the top surface of the strip a Reynolds number, at quiescent line, equal to about 60.000. The working temperatures are attained by steam flows, whereas the temperature control is ensured by the presence of a system of heat exchangers made of materials resistant to HF-containing oxidizing pickling solutions.

EXAMPLE 2

In this example there is described the process for descaling, pickling and finishing/passivating a cold-rolled and annealed AISI 409 type ferritic stainless steel coil having 0.8 mm thickness, 1,270 mm width, 19.6 t weight. According to the present invention, using the line described in example 1, operation was carried out under the following conditions: c=68 C/dm$^2$, k=7.2 s and rate=80 m/min.

Electrolytic Descaling Treatment and Hydromechanical Cleaning Treatment

| Process parameters | UNIT 1 (4 TANKS) | UNIT 2 (2 TANKS) |
|---|---|---|
| Rate [m/min] | 80 | 80 |
| $H_2SO_4$ [g/l] | 70 | 50 |
| $Fe^{3+}$ [g/l] | — | >10 |
| $Fe^{2+}$ [g/l] | Max 60 | Max 20 |
| $K = Fe^{3+}/Fe^{2+}$ | — | — |
| Temperature [° C.] | 70 ± 5 | 50 ± 5 |
| Total current [kA] | 43 | 21 |
| Brushing | Yes | Yes |
| Pressure rinsing | — | Yes |

After the electrolytic descaling treatment, the strip is subjected to the finishing/passivating and cleaning treatments in order to generate a surface passive film.

Chemical Finishing/Passivating Treatment and Hydromechanical Cleaning Treatment

| Process parameters | PICKLING (2 TANKS) | FINISHING PASSIVATING (1 TANK) |
|---|---|---|
| Rate [m/min] | 80 | 80 |
| $H_2SO_4$ [g/l] | — | 50 ÷ 60 |
| $Fe^{3+}$ [g/l] | — | 3 ÷ 8 |
| $Fe^{2+}$ [g/l] | — | Absent |
| Free HF [g/l] | — | 3 ÷ 8 |
| $H_2O_2$ [mol/l] | — | 0.08 ÷ 0.16 |
| Temperature [° C.] | — | 30 ± 5 |
| $Q_{recirculation}$ [$m^3$/h] | — | 300 |
| Rinsing and brushing | — | Yes |
| Pressure rinsing | — | Yes |

During the crossing of the chemical pickling unit the strip surfaces were kept moist in a room saturated with ambient-pressure steam.

At the end of the finishing/passivating treatment, hence at the line outlet, the strip appears completely pickled and having a good surface aspect. Reflection measuring conducted with a reflectometer (angle of reflection=60°) yielded values ranging from 28 to 35%. Scanning electron microscope (SEM) investigations of the surface layer proved the absence of residual oxides thereon.

During strip processing, the automated systems for controlling bath concentrations duly kept the provided concentrations by adjusting fresh reagent flows and spent solution discharges.

EXAMPLE 3

In this example there is described, the treatment for descaling, pickling and passivating a cold-rolled and annealed AISI 430 type ferritic stainless steel coil having 0.5 mm thickness, 1,570 mm width, 20.4 t weight. According to the present invention, using the line described in example 1, operation was carried out under the following conditions: c=74 C/$dm^2$, k=8 s and rate=90 m/min.

Electrolytic Descaling Treatment and Hydromechanical Cleaning Treatment

| Process parameters | UNIT 1 (4 TANKS) | UNIT 2 (2 TANKS) |
|---|---|---|
| Rate [m/min] | 90 | 90 |
| $H_2SO_4$ [g/l] | 60 ÷ 70 | 40 ÷ 50 |
| $Fe^{3+}$ [g/l] | — | 30 ÷ 40 |
| $Fe^{2+}$ [g/l] | 40 ÷ 50 | 15 ÷ 20 |
| $[Fe^{3+}]/[Fe^{2+}]$ | — | >1.5 |
| Temperature [° C.] | 70 ± 5 | 40 ±5 |
| Total current [kA] | 55 | 27 |
| Rinsing and brushing | Yes | Yes |
| Pressure rinsing | — | Yes |

At the end of this treatment, the strip surface appears perfectly descaled and free from detached but yet not removed oxide residues.

After the electrolytic descaling treatment the strip is subjected to the subsequent finishing/passivating and cleaning treatments, in order to generate a surface passive film.

Chemical Finishing/Passivating Treatment and Hydromechanical Cleaning Treatment

| Process parameters | PICKLING (2 TANKS) | FINISHING PASSIVATING (1 TANK) |
|---|---|---|
| Rate [m/min] | 90 | 90 |
| $H_2SO_4$ [g/l] | — | 30 |
| $Fe^{3+}$ [g/l] | — | 2 ÷ 5 |
| $Fe^{2+}$ [g/l] | — | — |
| Free HF [g/l] | — | 0 |
| $H_2O_2$ [mol/l] | — | 0.16 ÷ 0.32 |
| Temperature [° C.] | — | 25 ± 5 |
| $Q_{recirculation}$ [$m^3$/h] | — | 300 |
| Rinsing and brushing | — | Yes |
| Pressure rinsing | — | Yes |

During the crossing of the chemical pickling unit the strip surfaces were kept moist in a room saturated with ambient-pressure steam.

At the outlet of this section, hence at the line outlet, the strip appears completely pickled and having a good surface aspect. Reflection measuring conducted with a reflectometer (angle of reflection=60°) yielded values ranging from 40 to 44%. SEM investigations of the surface layer proved the absence of residual oxides and of localized attacks thereon.

During strip processing, the automated systems for controlling bath concentrations duly kept the provided concentrations by adjusting fresh reagent flows and spent solution discharges.

EXAMPLE 4

In this example there is reported the descaling, pickling and finishing treatment of a cold-rolled and annealed AISI 304 type austenitic stainless steel coil having 1.2 mm thickness, 1,570 mm width, 18.5 t weight. According to the present invention, using the line described in example 1, operation was carried out under the following conditions: c=65 C/$dm^2$, k=3 s and rate=75 m/min.

Electrolytic Descaling Treatment and Hydromechanical Cleaning Treatment

| Process parameters | UNIT 1 (4 TANKS) | UNIT 2 (2 TANKS) |
|---|---|---|
| Rate [m/min] | 75 | 75 |
| $H_2SO_4$ [g/l] | 90 ÷ 100 | 50 ÷ 100 |
| $Fe^{3+}$ [g/l] | — | >10 |
| $Fe^{2+}$ [g/l] | Max 60 | Max 50 |
| $[Fe^{3+}]/[Fe^{2+}]$ | — | — |
| Temperature [° C.] | 70 ± 5 | 70 ± 5 |
| Total current [kA] | 26 | 13 |
| Rinsing and brushing | Yes | Yes |
| Pressure rinsing | — | Yes |

At the outlet of this section, the surface appears descaled and free from residual oxides. The visual appearance is not yet that of the finished product. After the electrolytic descaling treatment the strip is subjected to the subsequent chemical pickling and cleaning treatments in order to generate a surface passive film.

Chemical Pickling Treatment and Hydromechanical Cleaning Treatment

| Process parameters | PICKLING (2 TANKS) | PICKLING (1 TANK) |
|---|---|---|
| Rate [m/min] | 75 | 75 |
| $H_2SO_4$ [g/l] | 100 ÷ 120 | 100 ÷ 120 |
| $Fe^{3+}$ [g/l] | 30 ÷ 40 | 35 ÷ 45 |
| $Fe^{2+}$ [g/l] | <25 | <20 |
| $[Fe^{3+}]/[Fe^{2+}]$ | 1 ± 0.2 | 1.8 ± 0.3 |
| Free HF [g/l] | 30 ÷ 35 | 30 ÷ 40 |
| $H_2O_2$ [mol/l] | — | — |
| Temperature [° C.] | 65 ± 3 | 65 ± 3 |
| $Q_{recirculation}$ [$m^3$/h] | 400 | 300 |
| Rinsing and brushing | | Yes |
| Pressure rinsing | Yes | Yes |

At the outlet of this section, hence at the line outlet, the strip appears completely pickled and having a good surface aspect. SEM investigations of the surface layer proved the absence of residual oxides and of attacks to grain boundaries. Electrochemical testing demonstrated the absence of residual chromium-depleted layers and the presence of a good-quality passive film.

During strip processing, the automated systems for controlling bath concentrations duly kept the provided concentrations by adjusting fresh reagent flows and spent solution discharges.

EXAMPLE 5

Herein it is exemplified the process for descaling, pickling and passivating a cold-rolled and annealed AISI 430 type ferritic stainless steel coil having 1.0 mm thickness, 1,020 mm width, 16.6 t weight.

According to the present invention, using the line described in example 1, operation was carried out under the following conditions: c=68 C/$dm^2$, k=7.1 s and rate=90 m/min.

Electrolytic Descaling Treatment and Hydromechanical Cleaning Treatment

| Process parameters | UNIT 1 (4 TANKS) | UNIT 2 (2 TANKS) |
|---|---|---|
| Rate [m/min] | 90 | 90 |
| $H_2SO_4$ [g/l] | 40 ÷ 60 | 40 ÷ 50 |
| $Fe^{3+}$ [g/l] | 20 ÷ 30 | 30 ÷ 40 |
| $Fe^{2+}$ [g/l] | 20 ÷ 30 | 10 ÷ 20 |
| $[Fe^{3+}]/[Fe^{2+}]$ | >1 | >1.2 |
| Temperature [° C.] | 60±5 | 40 ± 5 |
| Total current [kA] | 34 | 17 |
| Rinsing and brushing | Yes | Yes |
| Pressure rinsing | — | Yes |

After the electrolytic descaling treatment, the strip is subjected to the subsequent finishing/passivating and cleaning treatments in order to generate a surface passive film.

Chemical Finishing/Passivating Treatment and Hydromechanical Cleaning Treatment

| Process parameters | PICKLING (2 TANKS) | FINISHING PASSIVATING (1 TANK) |
|---|---|---|
| Rate [m/min] | 90 | 90 |
| $H_2SO_4$ [g/l] | — | 30 ÷ 40 |
| $Fe^{3+}$ [g/l] | — | 2 ÷ 5 |
| $Fe^{2+}$ [g/l] | — | — |
| Free HF [g/l] | — | 0 |
| $H_2O_2$ [mol/l] | — | 0.16 ÷ 0.32 |
| Temperature [° C.] | — | 25 ± 5 |
| $Q_{recirculation}$ [$m^3$/h] | — | 300 |
| Rinsing and brushing | Yes | Yes |
| Pressure rinsing | — | Yes |

During the crossing of the chemical pickling unit the strip surfaces were kept moist in a room saturated with ambient-pressure steam.

At the outlet of this section, hence at the end of the finishing/passivating treatment, the strip appears completely pickled and having a good surface aspect. Reflection measuring conducted with a reflectometer (angle of reflection=60°) yielded values ranging from 30 to 35%. SEM investigations of the surface layer proved the absence of residual oxides thereon.

During strip processing, the automated systems for controlling bath concentrations duly kept the provided concentrations by adjusting fresh reagent flows and spent solution discharges.

EXAMPLE 6

There is exemplified the descaling, pickling and finishing treatment of a hot-rolled and annealed AISI 304L type austenitic steel coil, having 2.7 mm thickness, 1,270 mm width, 19.3 t weight.

Preliminarily to the treatment according to the present invention, the same strip was subjected to scale breaking by grit blasting. According to the present invention using the line described in example 1, operation was carried out under the following conditions: c=115 C/$dm^2$, k=12.1 s and rate=55 m/min Electronic Descaling Treatment and Hydromechanical Cleaning Treatment

| Process parameters | UNIT 1 (4 TANKS) | UNIT 2 (2 TANKS) |
|---|---|---|
| Rate [m/min] | 55 | 55 |
| $H_2SO_4$ [g/l] | 160 ± 20 | 160 ± 20 |
| $Fe^{3+}$ [g/l] | — | >5 |
| $Fe^{2+}$ [g/l] | Max50 | 35 ÷ 40 |
| $[Fe^{3+}]/[Fe^{2+}]$ | — | — |
| Temperature [° C.] | 70 ±5 | 65 ± 5 |
| Total current [kA] | 40 | 20 |
| Rinsing and brushing | Yes | Yes |
| Pressurerinsing | −7 | Yes |

At the outlet of this section the surface is free from oxide scale and residues of the dissolution products by effect of the joint action of the hydromechanical brushing and high-pressure rinsing treatment. For this product type the process was completed with the pickling treatment. After the electrolytic descaling treatment, the strip was subjected to the subsequent pickling and cleaning treatments in order to remove the chromium-depleted alloy layer and to generate a surface passive film.

Chemical Pickling Treatment and Hydromechanical Cleaning Treatment

| Process parameters | PICKLING (2 TANKS) | PICKLING (1 TANK) |
|---|---|---|
| Rate [m/min] | 55 | 55 |
| $H_2SO_4$ [g/l] | 120 ± 20 | 120 ±20 |
| $Fe^{3+}$ [g/l] | 35 ÷ 45 | 40 ÷ 45 |
| $Fe^{2+}$ [g/l] | 20 ÷ 25 | 20 ÷ 25 |
| $[Fe^{3+}]/[Fe^{2+}]$ | >1.2 | >1.7 |
| Free HF [g/l] | 30 ÷ 40 | 35 ÷ 45 |
| $H_2O_2$ [mol/l] | — | — |
| Temperature [° C.] | 65 ± 5 | 60 ± 5 |
| $Q_{recirculation}$ [$m^3$/h] | 300 | 275 |
| Brushing | — | Yes |
| Pressure rinsing | — | Yes |

At the outlet of this section, hence at the line outlet, the strip appears completely pickled and having a good surface aspect. SEM investigations of the surface layer proved the absence of residual oxides and of localized attacks. The roughness at the line outlet, detected transversally to the direction of rolling, exhibited average $R_a$ values of about 2.4 μm.

During strip processing, the automated systems for controlling bath concentrations duly kept the provided concentrations by adjusting fresh reagent flows and spent solution discharges.

EXAMPLE 7

In this example there is described the descaling, pickling and finishing treatment of a hot-rolled and annealed AISI 316 austenitic steel coil having 3.0 mm thickness, 1,270 mm width, 19.3 t weight. Preliminarily to the treatment according to the present invention, the same strip was subjected to a scale breaking treatment by grit blasting. According to the present invention, using the line described in example 1, operation was carried out under the following conditions at a rate of 50 m/min.

Chemical Descaling Treatment and Hydromechanical Cleaning Treatment

| Process parameters | UNIT 1 (4 TANKS) | UNIT 2 (2 TANKS) |
|---|---|---|
| Rate [m/min] | 50 | 50 |
| $H_2SO_4$ [g/l] | 220 ± 20 | 220 ± 20 |
| $Fe^{3+}$ [g/l] | — | — |
| $Fe^{2+}$ [g/l] | Max 50 | Max 50 |
| $[Fe^{3+}]/[Fe^{2+}]$ | — | — |
| Temperature [° C.] | 95 ± 5 | 95 ± 5 |
| Rinsing and brushing | Yes | Yes |
| Pressure rinsing | — | Yes |

At the outlet of this section the surface is free from oxide scale. However, brushing and high-pressure rinsing notwithstanding, some dissolution product deposits still appear on the strip surface. For this type of product only the pickling treatment was carried out. After the electrolytic descaling treatment the strip was subjected to the subsequent pickling and cleaning treatments in order to remove the chromium-depleted alloy layer and to generate a surface passive film.

Chemical Pickling Treatment and Hydromechanical Cleaning Treatment

| Process parameters | PICKLING (2 TANKS) | PICKLING (1 TANK) |
|---|---|---|
| Rate [m/min] | 50 | 50 |
| $H_2SO_4$ [g/l] | 120 ± 20 | 120 ± 20 |
| $Fe^{3+}$ - [g/l] | 30 ÷ 40 | 35 ÷ 45 |
| $Fe^{2+}$ [g/l] | 30 ± 5 | 25 ± 5 |
| $[Fe^{3+}]/[Fe^{2+}]$ | >1.5 | >1.7 |
| Free HF [g/l] | 30 ÷ 40 | 35 ÷ 45 |
| $H_2O_2$ [mol/l] | — | — |
| Temperature [° C.] | 65 ± 5 | 60 ± 5 |
| $Q_{recirculation}$ [$m^3$/h] | 400 | 300 |
| Rinsing and brushing | — | Yes |
| Pressure rinsing | — | Yes |

At the end of the treatment, hence at the line outlet, the strip appears completely pickled and having a good surface aspect. SEM investigations of the surface layer proved the absence of residual oxides and of localized attacks. The roughness at the line outlet, detected transversally to the direction of rolling, exhibited average $R_a$ values of about 2.6 μm.

During strip processing, the automated systems for controlling bath concentrations duly kept the provided concentrations by adjusting fresh reagent flows and spent solution discharges.

EXAMPLE 8

In this example there is illustrated the descaling, pickling and finishing treatment of a cold-rolled and annealed AISI 430 type ferritic steel coil, having 2.7 mm thickness, 1,270 mm width, 18.5 t weight. In this case the process constants are c=115 C/$dm^2$ and k=10.0 s.

Preliminarily to the treatment according to the present invention, the same strip was subjected to a scale-breaking treatment by grit blasting. According to the present invention, using the line described in example 1, operation was carried out under the following conditions: c=115 C/$dm^2$, k=10 s and rate=45 m/min.

Electrolytic Descaling Treatment and Hydromechanical Cleaning Treatment

| Process parameters | UNIT 1 (4 TANKS) | UNIT 2 (2 TANKS) |
|---|---|---|
| Rate [m/min] | 45 | 45 |
| $H_2SO_4$ [g/l] | 100 ± 20 | 100 ± 20 |
| $Fe^{3+}$ [g/l] | — | >3 |
| $Fe^{2+}$ [g/l] | Max 50 | Max 50 |
| $[Fe^{3+}]/[Fe^{2+}]$ | — | — |
| Temperature [° C.] | 70 ± 5 | 70 ± 5 |
| Total current [kA] | 22 | 11 |
| Rinsing and brushing | Yes | Yes |
| Pressure rinsing | — | Yes |

At the end of the treatment the surface appeared free from oxide scale and dissolution product residues by effect of the joint action of the brushing and of the high-pressure rinsing. After the electrolytic descaling treatment the strip was subjected to the subsequent pickling, finishing/passivating and cleaning treatments in order to remove the chromium-depleted alloy layer and to generate a surface passive film.

Chemical Pickling and Finishing/Passivating Treatments and Hydromechanical Cleaning Treatment

| Process parameters | PICKLING (2 TANKS) | FINISHING (1 TANK) |
|---|---|---|
| Rate [m/min] | 45 | 45 |
| $H_2SO_4$ [g/l] | 120 ± 20 | 80 ± 20 |
| $Fe^{3+}$ [g/l] | 35 ÷ 40 | 25 ÷ 35 |
| $Fe^{2+}$ [g/l] | 10 ÷ 20 | — |
| Free HF [g/l] | 35 ÷ 40 | 10 ÷ 15 |
| $[Fe^{3+}]/[Fe^{2+}]$ | >1 | — |
| Stab. $H_2O_2$ [mo/l] | — | 0.12 ÷ 0.36 |
| Temperature [° C.] | 65 ± 5 | 35 ± 5 |
| $Q_{recirculation}$ [$m^3$/h] | 300 | 275 |
| Rinsing and brushing | Yes | Yes |
| Pressure rinsing | — | Yes |

At the end of the pickling and finishing treatment, hence at the line outlet, the strip appears completely pickled and having a good surface aspect. SEM investigations of the surface layer proved the absence of residual oxides and of localized attacks. The roughness at the line outlet, detected transversally to the direction of rolling, exhibited average $R_a$ values of about 2.1 μm.

During strip processing, the automated systems for controlling bath concentrations duly kept the provided concentrations by adjusting fresh reagent flows and spent solution discharges.

EXAMPLE 9

In this example there is illustrated the descaling, the pickling and the finishing of a hot-rolled and annealed AISI 409 type ferritic steel coil, having 3.0 mm thickness, 1,020 mm width, 20.6 t weight.

Preliminarily to the treatment according to the present invention, the same strip was subjected to a scale-breaking treatment by grit blasting. According to the present invention, using the line described in example 1, operation was carried out under the following conditions: c=115 C/$dm^2$, k=12,5 s and rate=40 m/min.

Electrolytic Descaling Treatment and Hydromechanical Cleaning Treatment

| Process parameters | UNIT 1 (4 TANKS) | UNIT 2 (2 TANKS) |
|---|---|---|
| Rate [m/min] | 40 | 40 |
| $H_2SO_4$ [g/l] | 80 ± 20 | 80 ± 20 |
| $Fe^{3+}$ [g/l] | — | >5 |
| $Fe^{2+}$ [g/l] | Max 45 | Max 45 |
| $[Fe^{3+}]/[Fe^{2+}]$ | — | — |
| Temperature [° C.] | 70 ± 5 | 70 ± 5 |
| Total current [kA] | 24 | 12 |
| Rinsing and brushing | Yes | Yes |
| Pressure rinsing | — | Yes |

At the outlet of this section the surface appears free from oxide scale and dissolution product residues by effect of the joint action of the brushing and of the high-pressure rinsing. After the electrolytic descaling treatment the strip was subjected to the subsequent pickling, finishing/passivating and cleaning treatments in order to remove the chromium-depleted alloy layer and to generate a surface passive film.

Chemical Pickling and Finishing/Passivating Treatments, and Hydromechanical Cleaning Treatment

| Process parameters | PICKLING (2 TANKS) | FINISHING (1 TANK) |
|---|---|---|
| Rate [m/min] | 40 | 40 |
| $H_2SO_4$ [g/l] | 120 ± 20 | 60 ± 10 |
| $Fe^{3+}$ [g/l] | 35 ± 5 | <8 |
| $Fe^{2+}$ [g/l] | 30 ± 5 | — |
| Free HF [g/l] | 25 ± 5 | <10 |
| $[Fe^{3+}]/[Fe^{2+}]$ | | — |
| $H_2O_2$ [mol/l] | — | >0.16 |
| Temperature [° C.] | 50 ± 5 | 25 ± 5 |
| $Q_{recirculation}$ [$m^3$/h] | 300 | 275 |
| Rinsing and brushing | — | Yes |
| Pressure rinsing | — | Yes |

At the outlet of this section, hence at the line outlet, the strip appears completely pickled and having a good surface aspect. SEM investigations of the surface layer proved the absence of residual oxides and of localized attacks. The roughness at the line outlet, detected transversally to the direction of rolling, exhibited average $R_a$ values of about 1.7 μm.

During strip processing, the automated systems for controlling bath concentrations duly kept the provided concentrations by adjusting fresh reagent flows and spent solution discharges.

The invention claimed is:

1. A process for descaling, pickling and finishing/passivating stainless steel strips, wherein the strip to be processed is subjected to the following sequence of steps:

an electrochemical and/or chemical descaling treatment, differentiated into two hydraulically distinct units using aqueous solutions, wherein:

said descaling, in case of electrolytic treatment, uses aqueous solutions containing in the first unit:

from 10 to 250 g/l $H_2SO_4$;

with <80 g/l total dissolved Fe;

and

≧15 g/l $Fe^{+3}$, with $Fe^{+3}/Fe^{+2}$≧1.0;

and, in the second unit:

from 10 to 250 g/l $H_2SO_4$;

≧2 g/l $Fe^{3+}$;

with <80 g/l total dissolved Fe;

and with $Fe^{3+}/Fe^{2+}$≧1.0;

with induction onto the strip of at least one anode-cathode or anode-cathode-anode polarity sequence applied by pairs of electrodes having the same polarity, between which the strip runs, with anodic treatment times ($t_a$) and anodic current density (I) selected so as to satisfy the relation $$t_a > k + c/I$$

where:

$t_a$ is the anodic treatment time [s];

k is an experimental constant, its values ranging from 2 to 15 s;

c is an experimental constant, its values ranging from 40 to 120 C/$dm^2$; and

I is the anodic current density, its values ranging from 1 to 100 $A/dm^2$ and with times during which the strip is not subjected to the electric field that range from the 5% to the 60% of the total electrolytic descaling time;

said descaling, in case of chemical treatment, uses aqueous solutions containing in both units from 25 to 280 g/l $H_2SO_4$;

said strip being subjected to said descaling treatment for an overall time comprised in the range 10-250 s, at temperatures comprised in the range 20-105° C.;

a chemical pickling, optional, and/or finishing/passivating treatment, differentiated into two hydraulically distinct units, wherein:

said chemical pickling treatment uses aqueous solutions containing:

from 20 to 180 g/l $H_2SO_4$;

from 5 to 50 g/l free HF;

$\geqq$15 g/l $Fe^{+3}$;

$Fe^{+3}/Fe^{+2} \geqq 0.8$;

with <80 g/l total dissolved Fe;

said chemical finishing/passivating treatment uses aqueous solutions containing:

from 10 to 100 g/l $H_2SO_4$;

from 0 to 15 g/l Free HF;

<20 g/l $Fe^{+3}$;

>0.03 mol/l $H_2O_2$;

said strip being subjected to said chemical pickling and/or finishing/passivating treatment for an overall time ranging from 2 to 250 s, at temperatures ranging from 20 to 80° C.; and there being provided, for each pickling and/or finishing/passivating treatment unit, a solution recirculation with a flow rate equal to at least 10 $dm^3/h$ per $m^2$ of strip;

there being provided, at least at the end of each descaling, pickling and/or finishing/passivating treatment unit, a mechanical and/or hydromechanical and/or water-employing cleaning treatment, optionally by water jets having a >100 bar pressure.

2. The process for descaling, pickling and finishing/passivating stainless steel strips according to claim 1, wherein electrodes, of a pair having the same polarity and between which a strip runs, are electrically separated, and said application of anode-cathode or anode-cathode-anode polarity sequence on the strip is attained connecting power supply units exclusively to electrodes adjacent and facing a same surface of the strip.

3. The process for descaling, pickling and finishing/passivating stainless steel strips according to claim 1, wherein the anodic/cathodic polarization time ratio is $\geqq$1.5.

4. The process for descaling, pickling and finishing/passivating hot-rolled, optionally annealed, stainless steel strips according to claim 1, wherein said descaling treatment is preceded by a mechanical and/or hydromechanical scale breaking/removing treatment.

5. The process for descaling, pickling and finishing/passivating austenitic stainless steel strips according to claim 1, wherein in said electrolytic descaling treatment there are used two different aqueous solutions:

a) in the first unit from 30 to 150 g/l $H_2SO_4$;

max 60 g/l dissolved Fe;

40-95° C. temperature;

b) in the second unit from 30 to 120 g/l $H_2SO_4$;

$\geqq$10 g/l $Fe^{+3}$, with $\geqq$1.0 $Fe^{+3}/Fe^{+2}$;

max 60 g/l dissolved Fe;

30-80° C. temperature.

6. The process for descaling, pickling and finishing/passivating ferritic or martensitic stainless steel strips according to claim 1, wherein in the electrolytic descaling treatment there are used solutions having a >20 g/l ferric (Fe(III)) ion concentration and a $Fe^{+3}/Fe^{+2}$ concentration ratio >1.5.

7. The process for descaling, pickling and finishing/passivating ferritic or martensitic stainless steel strips according to claim 1, wherein the time during which the strip is not subjected to the electric field ranges from the 15% and the 25% of the total electrolytic descaling time.

8. The process for descaling, pickling and finishing/passivating stainless steel strips according to claim 1, wherein the chemical pickling treatment for austenitic stainless steels is carried out in aqueous solutions optionally distinct in composition and/or temperatures and consisting of:

from 40 to 180 g/l $H_2SO_4$;

from 15 to 50 g/l free HF;

>20 g/l $Fe^{3+}$, with $Fe^{3+}/Fe^{2+}$>0.8;

max 70 g/l dissolved Fe;

50-75° C. temperature;

for times ranging from 20 to 150 s.

9. The process for descaling, pickling and finishing/passivating stainless steel strips according to claim 1, wherein the chemical pickling and finishing/passivating treatments of hot-rolled, optionally annealed, ferritic and martensitic stainless steels provide:

a chemical pickling treatment in aqueous solutions containing:

from 40 to 180 g/l $H_2SO_4$;

from 5 to 50 g/l free HF;

$\geqq$20 $Fe^{3+}$g/l, with $Fe^{3+}/Fe^{2+}$>0.8;

<80 g/l dissolved Fe;

at temperatures ranging from 20 to 70° C.;

for times ranging from 10 to 160 s;

a finishing treatment in aqueous solutions containing:

from 20 to 100 g/l $H_2SO_4$;

<20 g/l $Fe^{3+}$;

from 0 to 35 g/l free HF;

>0.03 mol/l $H_2O_2$;

at temperatures ranging from 20 to 50° C.;

for times ranging from 2 to 80 s.

10. The process for descaling, pickling and finishing/passivating stainless steel strips according to claim 1, wherein after the electrolytic descaling treatment the cold-rolled and annealed ferritic and martensitic stainless steels are subjected to the sole finishing/passivating treatment in aqueous solutions containing:

from 20 to 70 g/l $H_2SO_4$;

<15 g/l $Fe^{3+}$;

>0.05 mol/l $H_2O_2$;

from 0 to 15 g/l free HF;

at temperatures ranging from 20 to 50° C.;

for times ranging from 5 to 80 s.

11. The process for descaling, pickling and finishing/passivating stainless steel strips according to claim 1, wherein the finishing/passivating treatment is carried out applying the solution with spraying nozzles allowing a turbulent and homogeneous distribution of the solution onto the surfaces of the strip to be treated, so as to ensure a flow rate not lower than 15 $dm^3/h$ per $m^2$ of strip.

12. The process for descaling, pickling and finishing/passivating stainless steel strips according to claim 1, wherein in order to maintain the desired concentration of the ferric ions $Fe^{+3}$ and $Fe^{+3}/Fe^{+2}$ concentration ratio, at least stoichiometrical quantities of optionally stabilized hydrogen peroxide are inletted in the descaling and pickling solutions.

13. The process for descaling, pickling and finishing/passivating stainless steel strips according to claim 1, wherein while crossing the chemical pickling units the strips, subjected to the sole finishing/passivating treatment after the descaling treatment, are kept with their surfaces moist, in a room saturated with ambient-pressure steam.

14. A plant, suitable for carrying out the environment-friendly process for descaling, pickling and finishing/passivating, in a continuous, integrated and flexible manner, stainless steel strips, according to claim 1, characterized in that it comprises:

two hydraulically distinct units for the descaling treatment, each unit comprising:

at least one electrolytic or chemical cell, each electrolytic cell being provided with at least one set of pairs of electrodes facing the strip and located so as to induce at least one cathode-anode or anode-cathode-anode polarity sequence;

wherein in the electrolytic descaling cells the pairs of electrodes anodically polarizing the strip have a total length (L) such as to satisfy the relation:

$$L>(c/I+k)v$$

where:

L is the length of the pairs of electrodes anodically polarizing the strip [m];

c is an experimental constant, its values ranging from 40 to 120 $C/dm^2$;

I is the anodic current density at the highest plant rate, its values being selected in the range 1-100 $A/dm^2$;

k is an experimental constant, its values ranging from 2 to 15 s;

v is the highest plant rate [m/s];

means for recirculating the solution;

means for controlling the temperature of the solutions;

means for the hydromechanical and/or the water-employing rinsing treatment, optionally under high pressure, of the strip, located downstream of the second unit and optionally downstream of the first unit;

two hydraulically distinct units for the pickling and the finishing/passivating treatment, each unit comprising:

at least one chemical cell, preferably provided, for the finishing/passivating treatment, with means for spraying the solution onto the strip;

means for recirculating the solution, capable of ensuring a flow rate at least equal to 10 $dm^3/h$ per $m^2$ of strip;

means for controlling the temperatures desired for the solutions;

means for the hydromechanical and/or the water rinsing treatment, optionally under high pressure, of the strip, located downstream of the finishing/passivating treatment unit.

15. The plant, suitable for carrying out the environment-friendly process for descaling, pickling and finishing/passivating, in a continuous, integrated and flexible manner, stainless steel strips according to claim 1, wherein, in the electrolytic descaling cells, electrodes, of a pair having the same polarity and between which the strip runs, are electrically separated, and said application of anode-cathode or anode-cathode-anode polarity sequence on the strip is attained connecting power supply units exclusively to electrodes adjacent and facing a same surface of the strip.

16. The plant, suitable for carrying out the environment-friendly process for descaling, pickling and finishing/passivating, in a continuous, integrated and flexible manner, stainless steel strips according to claim 14, wherein in the electrolytic descaling cells the ratio between the lengths of the electrodes inducing the anodic and the cathodic polarity is greater than 1.5.

17. The plant, suitable for carrying out the environment-friendly process for descaling, pickling and finishing/passivating, in a continuous, integrated and flexible manner, stainless steel strips according to claim 14, wherein in the electrolytic descaling cells the polarity sequence is such that the strip outletted from said cells is subjected to anodic polarization as a last step.

18. The plant, suitable for carrying out the environment-friendly process for descaling, pickling and finishing/passivating, in a continuous, integrated and flexible manner, stainless steel strips according to claim 14, wherein the means for spraying the finishing/passivating solution onto the strip are spraying nozzles capable of ensuring a flow rate at least equal to 15 $dm^3/h$ per $m^2$ of strip and preferably a turbulence at the strip-solution interface having, at quiescent line and onto the top face of the strip, a Reynolds number equal to at least 50.000.

19. The plant, suitable for carrying out the environment-friendly process for descaling, pickling and finishing/passivating, in a continuous, integrated and flexible manner, stainless steel strips according to claim 14, wherein in the chemical pickling unit there are installed moisturizing systems that are capable, in the absence of pickling solution, of keeping moist the strip surfaces in a room saturated with ambient-pressure steam.

20. The method according to claim 1 wherein the steel is selected from the group consisting of austenitic stainless steel, ferritic stainless steel, martensitic stainless steel and optionally annealed hot-rolled stainless steel.

21. The method according to claim 20 wherein the chemical finishing/passivating solution is the same for austenitic stainless steel, ferritic stainless steel, martensitic stainless steel and optionally annealed hot-rolled stainless steel.

* * * * *